US009316460B2

(12) United States Patent
Cheng et al.

(10) Patent No.: US 9,316,460 B2
(45) Date of Patent: Apr. 19, 2016

(54) ONE HAND OPERATIONAL COMBO SIGHT DEVICE

(71) Applicants: Carson Cheng, City of Industry, CA (US); Jason Michael Cheng, City of Industry, CA (US)

(72) Inventors: Carson Cheng, City of Industry, CA (US); Jason Michael Cheng, City of Industry, CA (US)

(73) Assignee: NcSTAR, Inc., City of Industry, CA (US)

( * ) Notice: Subject to any disclaimer, the term of this patent is extended or adjusted under 35 U.S.C. 154(b) by 0 days.

(21) Appl. No.: 14/446,332

(22) Filed: Jul. 30, 2014

(65) Prior Publication Data

US 2016/0033232 A1 Feb. 4, 2016

(51) Int. Cl.
*F41G 1/38* (2006.01)
*F41G 1/34* (2006.01)

(52) U.S. Cl.
CPC ..... *F41G 1/345* (2013.01)

(58) Field of Classification Search
CPC ..... F41G 1/345; F41G 1/38; F41G 11/003
USPC ..... 42/122, 113, 111, 114, 115, 90, 42/124–126, 128–129, 140–141
See application file for complete search history.

(56) References Cited

U.S. PATENT DOCUMENTS 5,351,429 A * 10/1994 Ford ..... F41G 1/35 362/110
5,383,278 A * 1/1995 Kay ..... F41G 1/30 124/87
5,448,402 A * 9/1995 Lorenzana ..... B62J 6/20 116/28 R
8,327,573 B1 * 12/2012 Cheng ..... 42/115
8,393,109 B2 * 3/2013 Gilmore ..... F41G 1/345 33/284
8,505,228 B2 * 8/2013 Cheng ..... F41C 27/00 42/111
8,599,481 B2 * 12/2013 Thomas ..... F41G 1/345 359/399
2003/0089018 A1 * 5/2003 Reynolds ..... F41A 9/19 42/105
2006/0064914 A1 * 3/2006 Greer ..... F41A 11/02 42/77
2011/0167708 A1 * 7/2011 Cheng ..... F41G 1/345 42/114
2011/0232152 A1 * 9/2011 Thomas ..... F41G 1/345 42/125
2012/0311909 A1 * 12/2012 Cheng ..... F41G 11/003 42/90
2012/0311913 A1 * 12/2012 Cheng ..... 42/115
2014/0118821 A1 * 5/2014 Thomas ..... F41G 1/345 359/421
2014/0153119 A1 * 6/2014 Schmitt ..... G02B 23/16 359/818
2014/0237884 A1 * 8/2014 Koesler ..... F41G 1/30 42/119
2014/0259853 A1 * 9/2014 Crispin ..... F41G 1/38 42/124
2014/0305022 A1 * 10/2014 Chung ..... F41G 1/16 42/113

* cited by examiner

*Primary Examiner* — Michael David
(74) *Attorney, Agent, or Firm* — Raymond Y. Chan; David and Raymond Patent Firm

(57) ABSTRACT

A sight device includes a mounting base for detachably mounting on the firearm, a sight unit upwardly extended from the mounting base, and a sight arrangement provided at the mounting base at a position underneath the sight unit, wherein the sight arrangement includes first and second modules. The first sight module includes a first light housing frontwardly extended from the mounting base and a first light unit supported in the first light housing for generating a light beam parallel to a bore axis of the firearm and close to the bore axis of the firearm to reduce an off-axis bore height. The second sight modules includes a second light housing frontwardly extended from the mounting base and spaced part from the first light housing, and a second light unit supported in the second light housing for illumination.

18 Claims, 10 Drawing Sheets

ONE HAND OPERATIONAL COMBO SIGHT DEVICE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a sight device, and more particular to a one hand operational combo sight device, which integrates a sight device with different sight modules for facilitating an operator to use a firearm in different environments.

2. Description of Related Arts

Conventional firearm, such as a gun or a rifle, usually needs different firearm accessories for assisting the operator to accurately locate the target and perform the shooting. Sighting device, such as a scope, reflex sight, telescope, camera lens module, or binoculars, generally comprises a tubular lens housing and a lens supported in the lens housing. For example, scopes are sighting device and are commonly used in conjunction firearms, such as rifles, to give an accurate aiming point and to aid the operator in properly aligning a barrel of the firearm with a desired target. Accordingly, two lenses are provided at two ends of the lens housing to define an objective end and a sight (ocular) end. The scope further comprises a scope luminous element which is powered by a battery and is operatively provided in the lens housing for illumining a scope reticle thereof.

Another firearm accessory, such as an illumination sight module, is mounted on the firearm to provide low light targeting and/or illumination. The illumination sight module generally comprises a tubular light housing and a plurality of illumination elements which are powered by a battery and are received in the light housing for light generation. Accordingly, the illumination elements are arranged for generating different colors, wherein red lights are best for preserving night vision, blue light provides high contrast for detecting blood, and white light allows the operator to see clearly under dark environment.

Laser sight is another sight module to replace or augment other types of sights. The laser sight emits a beam of coherent visual light which indicates the direction in which the barrel of the firearm is aimed. Accordingly, the laser sight should be mounted to the firearm close to the barrel axis thereof for enhancing the accuracy of the aiming.

It is worth mentioning that the scope and sight modules must be mounted on the firearm to parallel to the barrel axis of the firearm. In other words, when the scope is mounted on top of the firearm, the sight modules must be mounted to the side of the firearm which will block the light by the firearm. If the illumination sight module or the laser sight is mounted underneath the firearm, such as the bottom side of the handguard, the gripping area of the handguard will be minimized. It is worth mentioning that the scope and the sight modules must be located close to the barrel axis of the firearm in order to precisely align the scope and the sight modules with the barrel axis of the firearm.

Furthermore, when different sight modules are mounted on the firearm, the operator must individually operate the illumination sight modules to selectively adjust the illumination colors and light effects respectively. The sight modules are operated by their own battery supply such that additional weight will be added on the firearm. It is important to minimize the weight of the firearm accessories, so that any kind of additional accessories will be additional duties for the operator.

SUMMARY OF THE PRESENT INVENTION

The invention is advantageous in that it provides a one hand operational combo sight device, which integrates a sight device with different sight modules for facilitating an operator to use a firearm in different environments.

Another object of the present invention is to provide a one hand operational combo sight device, wherein the operator is able to operate the sight modules by one hand, so as to simplify the operations of the sight modules by means of one hand operation.

Another advantage of the invention is to a one hand operational combo sight device, wherein the sight modules are located underneath the sight unit to enhance the accuracy of the aiming.

Another advantage of the invention is to a one hand operational combo sight device, which is a low profile configuration to minimize a distance between the sight unit and the firearm when the sight device is mounted on the firearm.

Another object of the present invention is to provide a one hand operational combo sight device, wherein a single integrated control panel is provided to control both the sight unit and the sight modules. Therefore, the operator is able to control the sight unit and the sight modules by one hand of the operator.

Another object of the present invention is to provide a one hand operational combo sight device, wherein the sight module provides different lights such as flash light and/or navigation light. The navigation light, such as white navigation light and red navigation light, which can support the night vision for the operator and can help the operator quickly adapting in a low light environment.

Another object of the present invention is to provide a one hand operational combo sight device, which employs one single power supply to operate with electrical components of the sight modules, so as to minimize the unnecessary component of the sight modules and to reduce the overall weight of the sight device.

Another object of the present invention is to provide a one hand operational combo sight device, which does not require altering the original mounting structure of the firearm, so as to minimize the manufacturing cost of the firearm incorporating with the sight device.

Another object of the present invention is to provide a one hand operational combo sight device, wherein no expensive or complicated structure is required to employ in the present invention in order to achieve the above mentioned objects. Therefore, the present invention successfully provides an economic and efficient solution for providing an all-in-one sight device with different light configurations to minimize additional firearm accessories on the firearm.

Additional advantages and features of the invention will become apparent from the description which follows, and may be realized by means of the instrumentalities and combinations particular point out in the appended claims.

According to the present invention, the foregoing and other objects and advantages are attained by a sight device for mounting on a firearm, comprising:

a mounting base for detachably mounting on the firearm;

a sight unit upwardly extended from the mounting base; and a sight arrangement provided at the mounting base at a position underneath the sight unit, wherein the sight arrangement comprises first and second modules.

The first sight module comprises a first light housing frontwardly extended from the mounting base and a first light unit supported in the first light housing for generating a light beam parallel to a bore axis of the firearm and close to the bore axis of the firearm to reduce an off-axis bore height.

The second sight modules comprises a second light housing frontwardly extended from the mounting base and spaced part from the first light housing, and a second light unit supported in the second light housing for generating navigation light.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
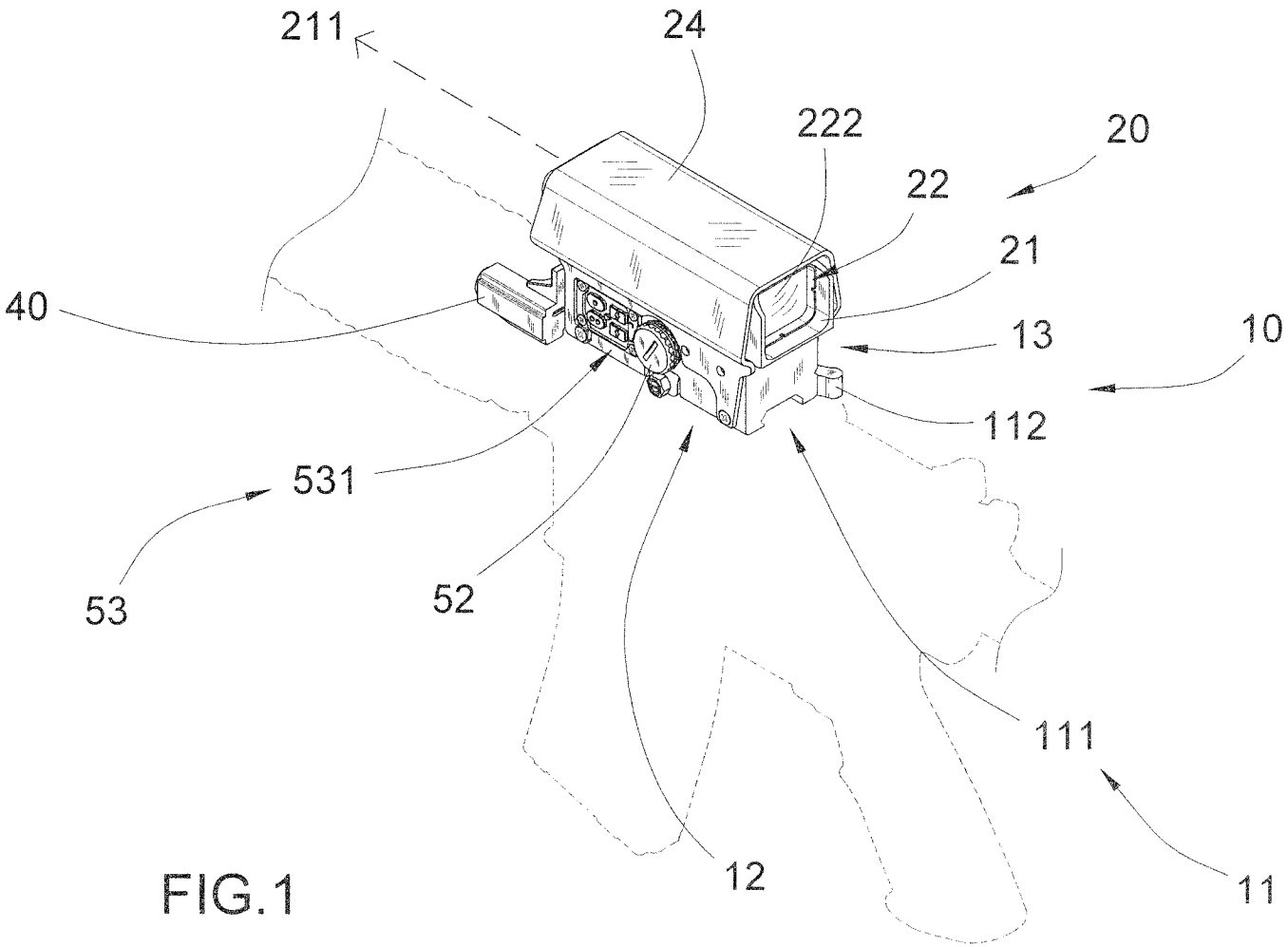
FIG. 1 is a rear perspective view of a sight device according to a first preferred embodiment of the present invention.
Figure 2:
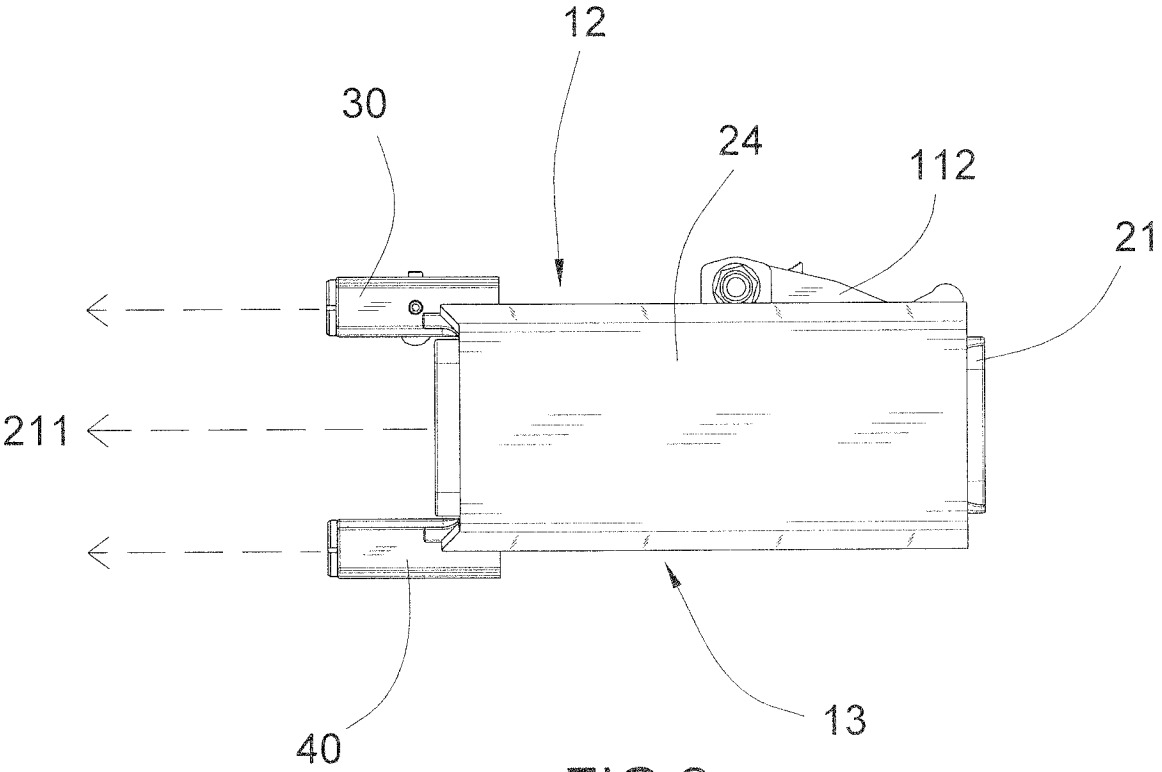
FIG. 2 is a top view of the sight device according to the above first preferred embodiment of the present invention.
Figure 3:
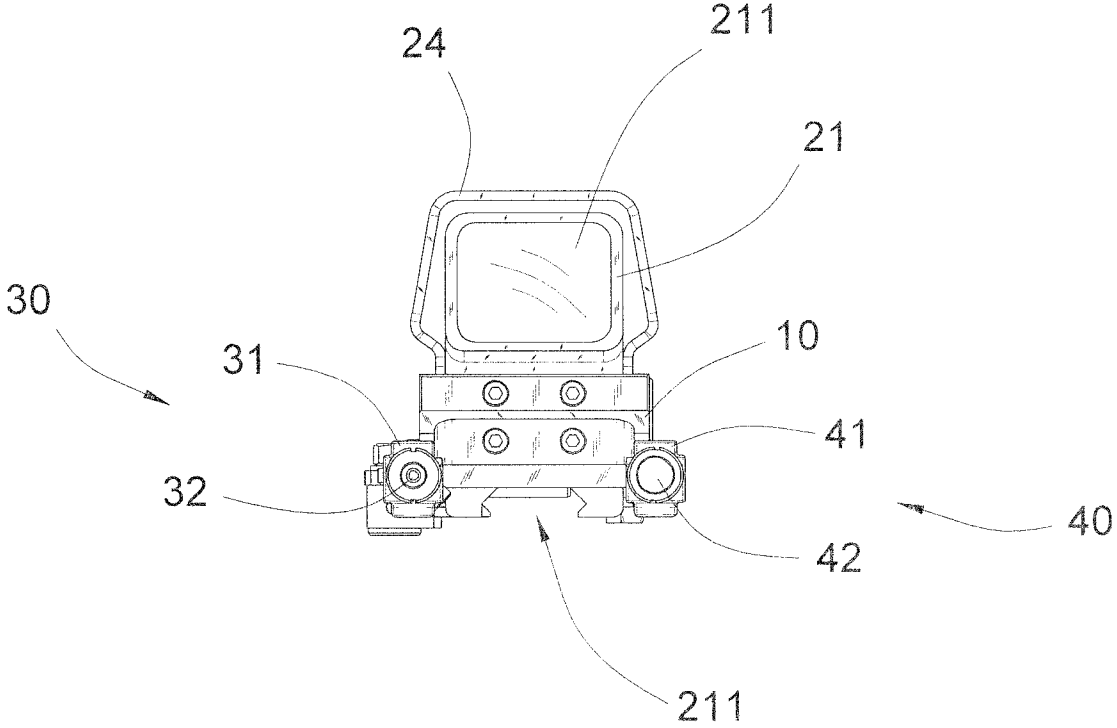
FIG. 3 is a front view of the sight device according to the above first preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1 to 4 of the drawings, a sight device according to a first preferred embodiment of the present invention is illustrated, wherein the sight device is adapted for detachably mounting on a firearm, especially on top of a rifle, having a bore axis. Accordingly, the sight device of the present invention comprises a mounting base 10, a sight unit 20, and a sight arrangement.

The mounting base 10 comprises an attachment arrangement 11 provided at a bottom side of the mounting base 10 for detachably attaching onto the firearm. The mounting arrangement 11 can be configured to have a "Weaver" mounting structure, a "Picatinny" mounting structure, or "KeyMod" mounting structure to detachably couple at the firearm. Preferably, the mounting arrangement 11 is a quick releasing mount having a mounting slot 111 at the bottom side of the mounting base 10 and comprising a locking lever 112 to rapidly lock and unlock the mounting arrangement 11 at the firearm. Preferably, the mounting base 10 has a low profile design to be mounted on the firearm. Furthermore, the mounting base 10 has two sidewalls defining as a thumb side 12 and a finger side 13. When the operator hands on the firearm, such as the handguard of the rifle, the thumb of the operator can reach the thumb side 12 of the mounting base 10 while the fingers of the operator can reach the finger side 13 of the mounting base 10.

The sight unit 20, according to the first embodiment, is a reflex optic, wherein the sight unit 20 comprises a lens housing 21 upwardly extended from a top platform of the mounting base 10, an enlarged optic window 22 supported in the lens housing 21 for allowing the operator a wide field of view, and a sight luminous element 23 for generating a reflex optic dot on the optic window 22.

Accordingly, the lens housing 21 has an elongated structure having an objective end and a sight end, and defining a sight axis 211 parallel to the bore axis of the firearm. The lens housing 21 is securely attached onto the mounting base 10 via a fastening unit. Preferably, the lens housing 21 has a rectangular cross section to enlarge the optic window 22.

The optic window 22 is defined at the objective end of the lens housing 21, wherein an objective lens 221 is supported at the objective end of the lens housing 21 within the optic window 22 while a sight lens 222 is supported at the sight end of the lens housing 21.

The sight luminous element 23 is supported within the lens housing 21 for generating the reflex optic dot on the objective lens 221 at the optic window 22. The sight unit 20 further comprises a position adjustment module 24 formed at the mounting base 10, preferably at a sidewall thereof, for selectively adjusting the position of the reflex optic dot on the objective lens 221 at the optic window 22. Preferably, the position adjustment module 24 comprises an elevation adjustor and a windage adjustor spacedly mounted at the mounting base 10 to selectively adjust the elevation and windage positions of the sight luminous element 23 in order to adjust the position of the reflex optic dot on the objective lens 221 at the optic window 22.

Figure 4:
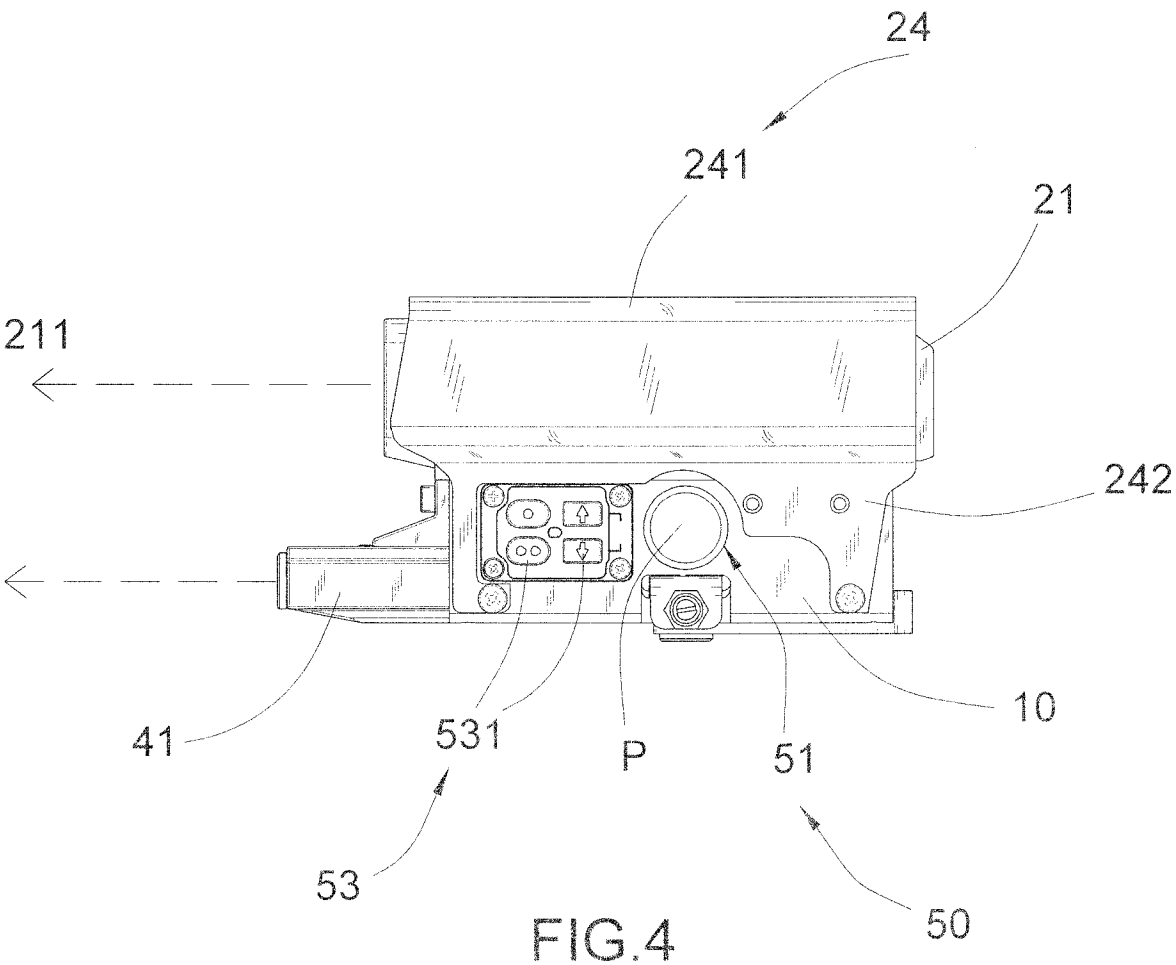
FIG. 4 is a side view of the sight device according to the above first preferred embodiment of the present invention.
Figure 5:
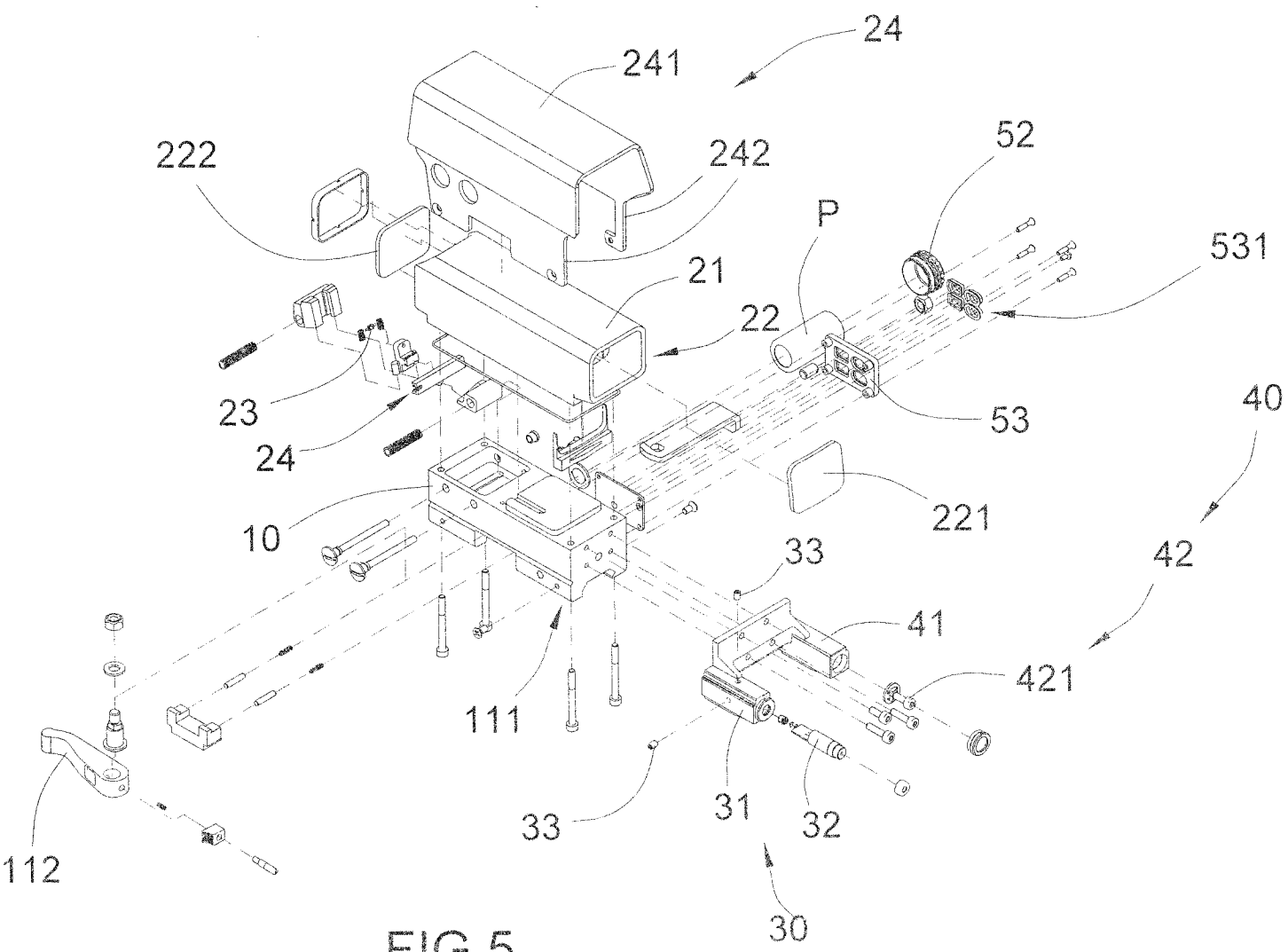
FIG. 5 is an exploded perspective view of the sight device according to the above first preferred embodiment of the present invention.
Figure 6:
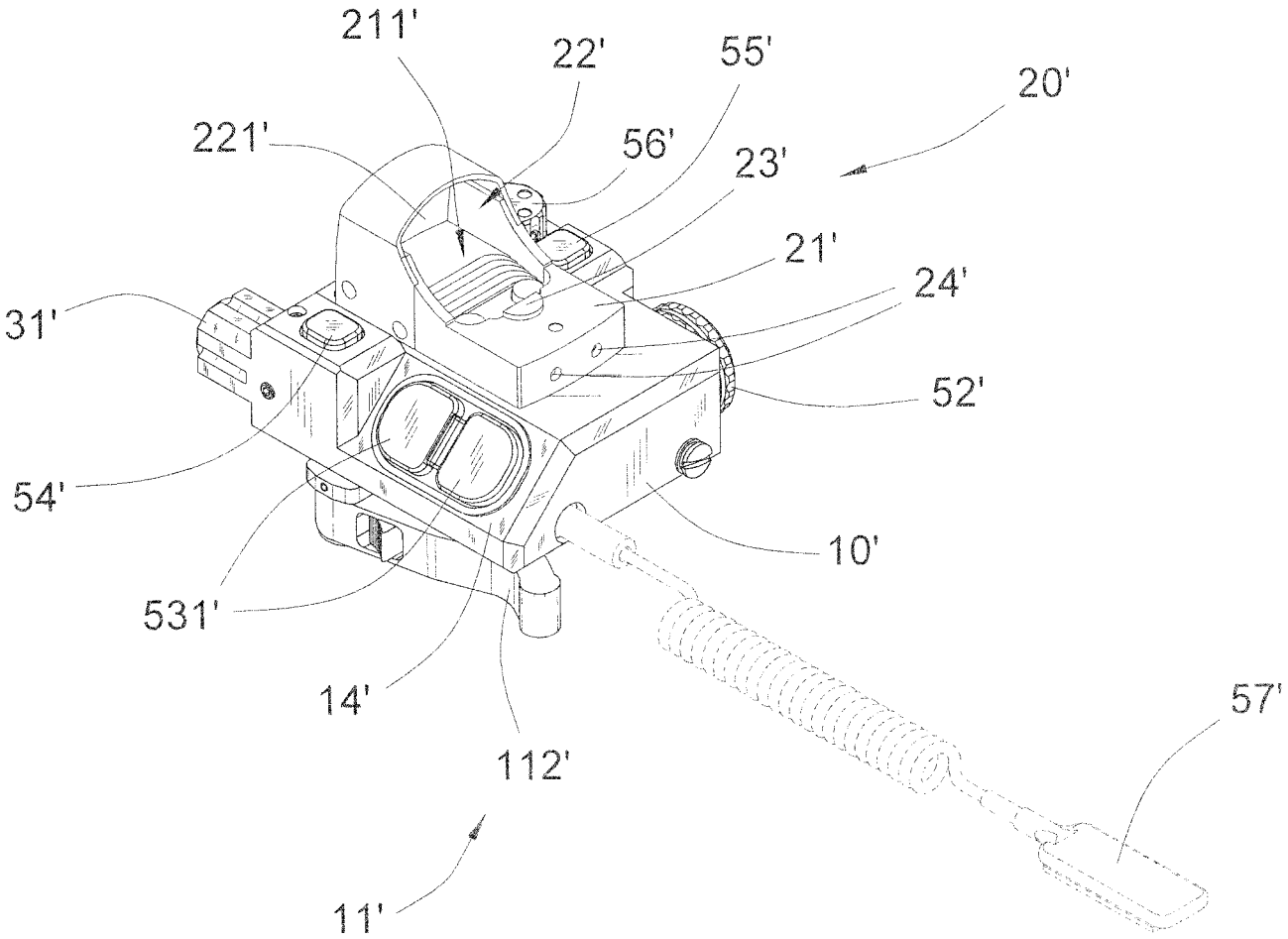
FIG. 6 is a rear perspective view of a sight device according to a second preferred embodiment of the present invention.

The sight unit 20 further comprises an armored shield 24 mounted around the lens housing 21 for protecting the lens housing 21 from damage and for rough handling. As shown in FIGS. 1, 4 and 5, the armored shield 24 comprises a U-shaped shielding body 241 enclosing the top side and two sidewalls of the lens housing 21, and two coupling legs 242 downwardly extended from two side edges of the shielding body 241 to couple at two sidewalls of the mounting base 10. In other words, the lens housing 21 is encircled within and protected by the mounting base 10 and the armored shield 24.

According to the preferred embodiment, the sight arrangement is provided at the mounting base 10 at a position below the sight unit 20. In other words, the sight arrangement is located between the sight unit 20 and the firearm when the mounting base 10 is mounted thereon.

The sight arrangement comprises two sight modules 30, 40 for providing different light effects. The first sight module 30 comprises a first light housing 31 frontwardly extended from the mounting base 10 and a first light unit 32 supported in the first light housing 31 for generating a light beam parallel to the bore axis of the firearm.

The first light housing 31 has a tubular shape frontwardly protruded from a front wall of the mounting base 10 and defining a first light axis parallel to the bore axis of the firearm.

Preferably, the first light unit 32 is a green diode pumped solid state laser supported in the first light housing 31 for generate a visible-light laser beam at the first light axis. It is worth mentioning that since the first light housing 31 is mounted at the mounting base 10, it will bring the first light unit 32 closer to the bore of the barrel, for easier aiming and to reduce the off-axis bore height.

The first sight module 30 further comprises a light adjustor 33 provided at the first light housing 31 for selectively adjusting the elevation and windage positions of the first light unit 32, such that the visible-light laser beam can be adjusted for windage and elevation to help with zeroing the laser beam to the firearm's bullet impact at a target.

The second sight module 40 comprises a second light housing 41 frontwardly extended from the mounting base 10 and spaced part from the first light housing 31, and a second light unit 42 supported in the second light housing 41 for illumination.

The second light housing 41 also has a tubular shape frontwardly protruded from the front wall of the mounting base 10 and defining a second light axis parallel to the bore axis of the firearm. The first and second light axes are parallel with each other on the same planar manner. Preferably, the first and second light housings 31, 41 are frontwardly extended from the front wall of the mounting base 10 at two side portions thereof respectively, such that the sight unit 20 is located between the first and second light housings 31, 41. In particular, the first and second light housings 31, 41 are spaced apart to clear a front iron sight on the firearm when the mounting base 10 is mounted on the firearm. Therefore, the lights from the first and second sight modules 30, 40 will not be blocked by the front iron sight of the firearm.

According to the preferred embodiment, the second sight module 40 is arranged for generating navigation light. The navigation light is low level LED light that helps the operator in low light conditions. The navigation light provides just enough lighting for the operator to maneuver and see close objects in dark environments, without giving away the operator's positions to an adversary. The low level navigation light also preserve the operator's "night vision" that allows the operators eyes minimal time to adjust to complete darkness.

In particular, the second light unit 42 comprises a plurality of illumination elements 421 being selectively activated for generating navigation light in different colors respectively. Preferably, four illumination elements 421 are supported within the second light housing 41 for generating four different colors of navigation light, such as white, blue, red, and green. Accordingly, the low level white navigation light allows the operator to see objects and their natural color the best, but is not the best color to preserve the operator's "night vision". The low level blue navigation light is good for hunters to track blood trails. The low level red navigation light is the best color to preserve the operator's night vision. The low level green navigation light is another color to help with seeing the environment and to preserve the operator's night vision. Therefore, the operator is able to selectively activate one of the illumination elements 421 to generate a desired color navigation light.

The sight arrangement further comprises an integrated control module 50 provided at the mounting base 10 to selectively operate the first and second sight modules 30, 40. According to the first embodiment, the integrated control module 50 also controls the sight unit 20.

As shown in FIGS. 4 and 5, the integrated control module 50 comprises a power source compartment 51 formed at the sidewall of the mounting base 10, preferably at the thumb side 12 of the mounting base 10, for receiving a power supply P as a single power source to operatively link with the sight luminous element 23, the first light unit 32, and the second light unit 42, and a compartment cover 52 detachably coupled at the sidewall of the mounting base 10 to enclose the power source compartment 51. Therefore, the sight luminous element 23, the first light unit 32, and the second light unit 42 will share one single power source to reduce the overall weight of the sight device on the firearm and to simplify the electrical configuration of the sight device with respect to the sight unit 20 and the sight modules 30, 40.

The integrated control module 50 further comprises a control panel 53 provided at the sidewall of the mounting base 10, wherein a plurality of control switches 531 are provided at the control panel 53 for independently operating the sight unit 20 and the sight modules 30, 40. For example, two control switches 531 server as two sight control switches to switch on and off the sight luminous element 23 respectively and to control reflex optic dot illumination level. One of the control switches 531 serves as a first light control switch to selectively activate the first light unit 32. One of the control switches 531 serves as a second light control switch to selectively switch on and off the second light unit 32 and to selectively activate one of the illumination elements 421 for generate the desired color of navigation light. It is worth mentioning that the control panel 53 can be provided at any side of the mounting base 10 to operate the sight unit 20 and the sight modules 30, 40. Preferably, the control panel 53 is provided at the thumb side 12 of the mounting base 10, such that the operator can easily reach the control panel 53 by the finger of the operator. In other words, the control panel 53 allows the operator's hand on the firearm, such as the handguard of the rifle, easy access to activate the sight unit 20 and the sight modules 30, 40.

As shown in FIGS. 6 to 10, a sight device according to a second embodiment illustrates an alternative mode of the first embodiment, wherein the sight device of the second embodiment comprises a mounting base 10', a sight unit 20', and a sight arrangement 30'.

Accordingly, the mounting base 10' of the second embodiment is similar to the mounting base 10 of the first embodiment, wherein the mounting base 10' comprises an attachment arrangement 11' provided at a bottom side of the mounting base 10' for detachably attaching onto the firearm. Preferably, the mounting arrangement 11' is a quick releasing mount having a mounting slot 111' at the bottom side of the mounting base 10' and comprising a locking lever 112' to rapidly lock and unlock the mounting arrangement 11' at the firearm. Preferably, the mounting base 10' has a low profile design to be mounted on the firearm. Furthermore, the mounting base 10' has two sidewalls defining as a thumb side 12' and a finger side 13'.

The sight unit 20', according to the second embodiment, is a micro reflex optic, wherein the sight unit 20' comprises a lens housing 21' upwardly extended from a top platform of the mounting base 10', an optic window 22' supported in the lens housing 21', and a sight luminous element 23' for generating a reflex optic dot on the optic window 22'.

Accordingly, the lens housing 21' has a mounting platform 211' detachably coupled on the top platform of the mounting base 10' via a fastening unit. The optic window 22' is upwardly extended from the mounting platform 211' of the lens housing 21', wherein an objective lens 221' is supported by the lens housing 21' within the optic window 22'.

The sight luminous element 23' is supported on top of the mounting platform 211' of the lens housing 21' for generating the reflex optic dot on the objective lens 221' at the optic window 22'.

The sight unit 20' further comprises a position adjustment module 24' formed at the mounting platform 211' of the lens housing 21', preferably at a rear wall thereof, for selectively adjusting the position of the reflex optic dot on the objective lens 221' at the optic window 22'. Preferably, the position adjustment module 24' comprises an elevation adjustor and a windage adjustor spacedly mounted at the lens housing 21' to selectively adjust the elevation and windage positions of the sight luminous element 23' in order to adjust the position of the reflex optic dot on the objective lens 221' at the optic window 22'.

The sight unit 20' further comprises a sight unit power source compartment 25' provided in the lens housing 21' for receiving a sight unit power supply to operatively link with the sight luminous element 23'.

According to the second embodiment, the sight arrangement is also provided at the mounting base 10' at a position below the sight unit 20'. In other words, the sight arrangement is located between the sight unit 20' and the firearm when the mounting base 10' is mounted thereon.

Similar to the first embodiment, the sight arrangement of the second embodiment comprises two sight modules 30', 40' for providing different light effects. The first sight module 30' comprises a first light housing 31' frontwardly extended from the mounting base 10' and a first light unit 32' supported in the first light housing 31' for generating a light beam parallel to the bore axis of the firearm. The first light housing 31' has a tubular shape frontwardly protruded from a front wall of the mounting base 10' and defining a first light axis parallel to the bore axis of the firearm.

Preferably, the first light unit 32' is a green diode pumped solid state laser supported in the first light housing 31' for generate a visible-light laser beam at the first light axis. It is worth mentioning that since the first light housing 31' is mounted at the mounting base 10', it will bring the first light unit 32' closer to the bore of the barrel, for easier aiming and to reduce the off-axis bore height.

The second sight module 40' comprises a second light housing 41' frontwardly extended from the mounting base 10' and spaced part from the first light housing 31', and a second light unit 42' supported in the second light housing 41' for illumination. The second light housing 41 also has a tubular shape frontwardly protruded from the front wall of the mounting base 10 and defining a second light axis parallel to the bore axis of the firearm. The first and second light axes are parallel with each other on the same planar manner. Preferably, the first and second light housings 31', 41' are frontwardly extended from the front wall of the mounting base 10' at two side portions thereof respectively, such that the sight unit 20' is located between the first and second light housings 31', 41'. In particular, the first and second light housings 31', 41' are spaced apart to clear a front iron sight on the firearm when the mounting base 10' is mounted on the firearm. Therefore, the lights from the first and second sight modules 30', 40' will not be blocked by the front iron sight of the firearm.

According to the preferred embodiment, the second sight module 40' is arranged for generating navigation light, wherein the second light unit 42' comprises a plurality of illumination elements 421' being selectively activated for generating navigation light in different colors respectively. In particular, the illumination elements 421' are diodes coupled on a circuit board for generating four different colors of navigation light, such as white, blue, red, and green.

Figure 7:
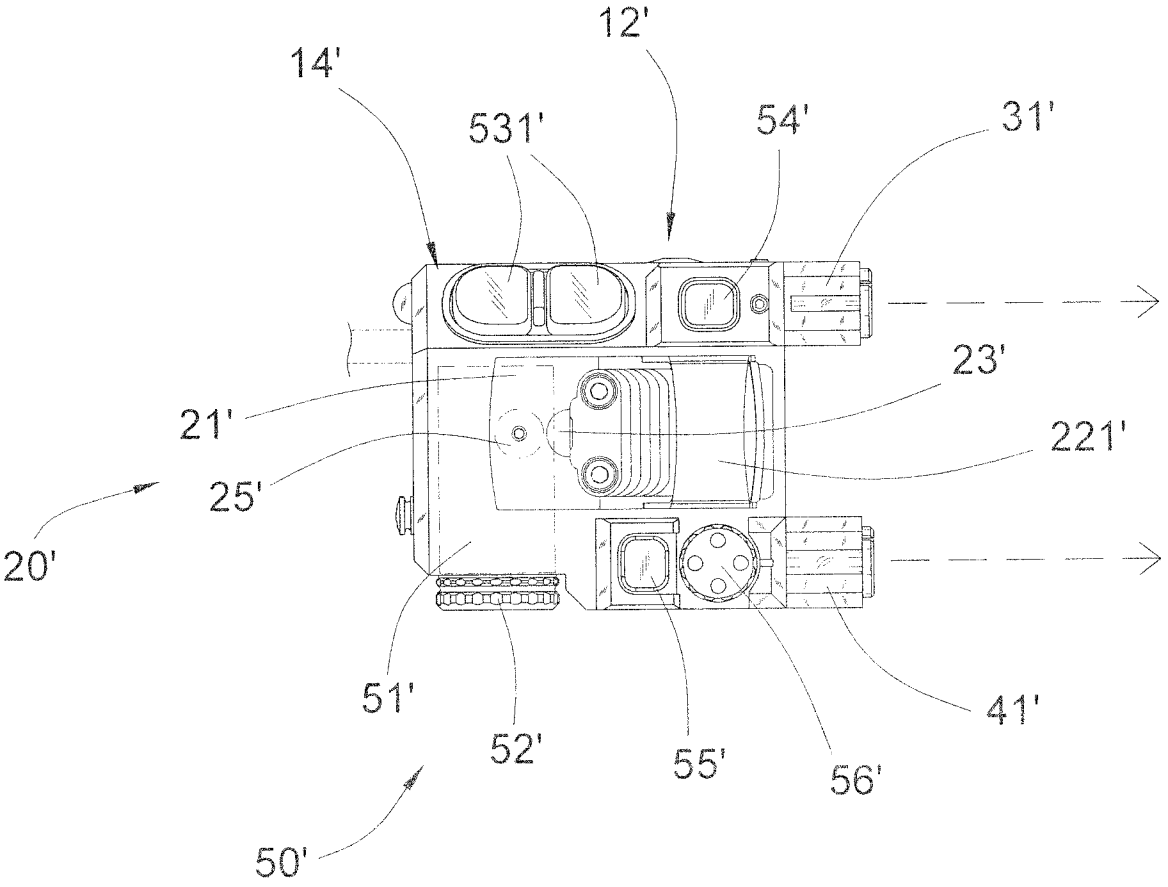
FIG. 7 is a top view of the sight device according to the above second preferred embodiment of the present invention.
Figure 8:
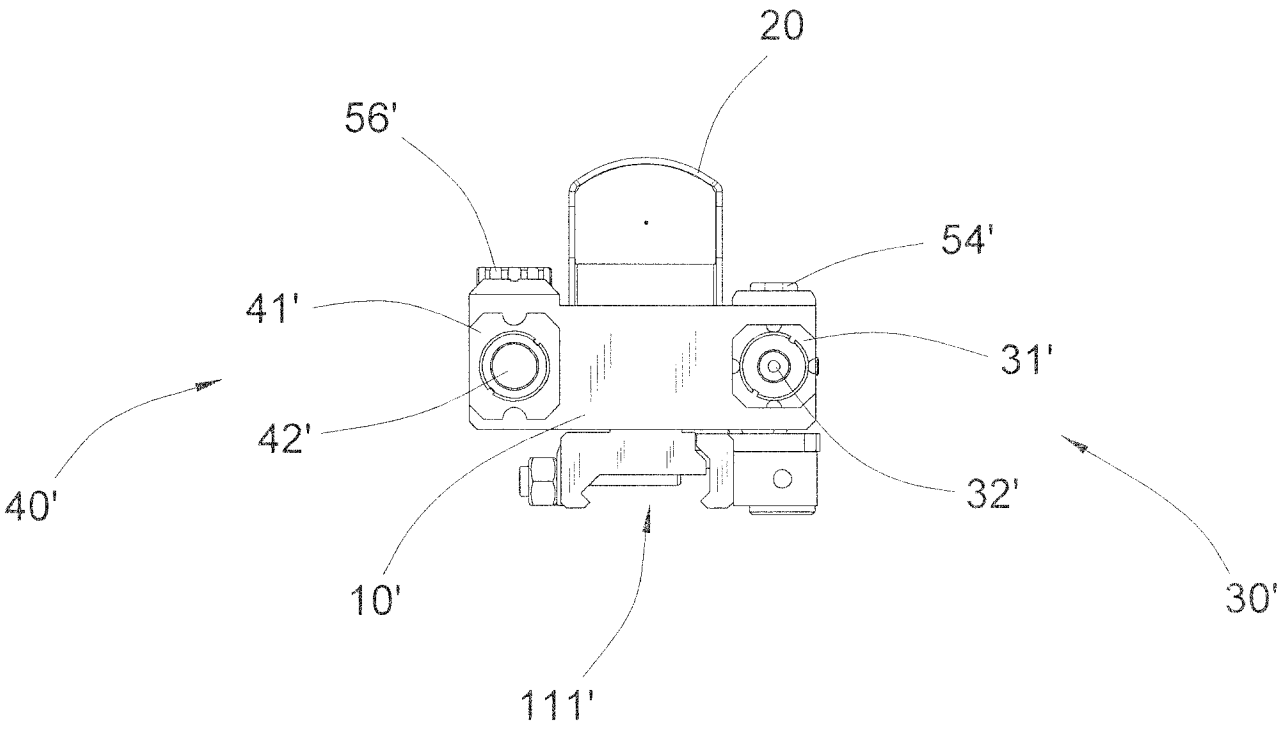
FIG. 8 is a front view of the sight device according to the above second preferred embodiment of the present invention.
Figure 9:
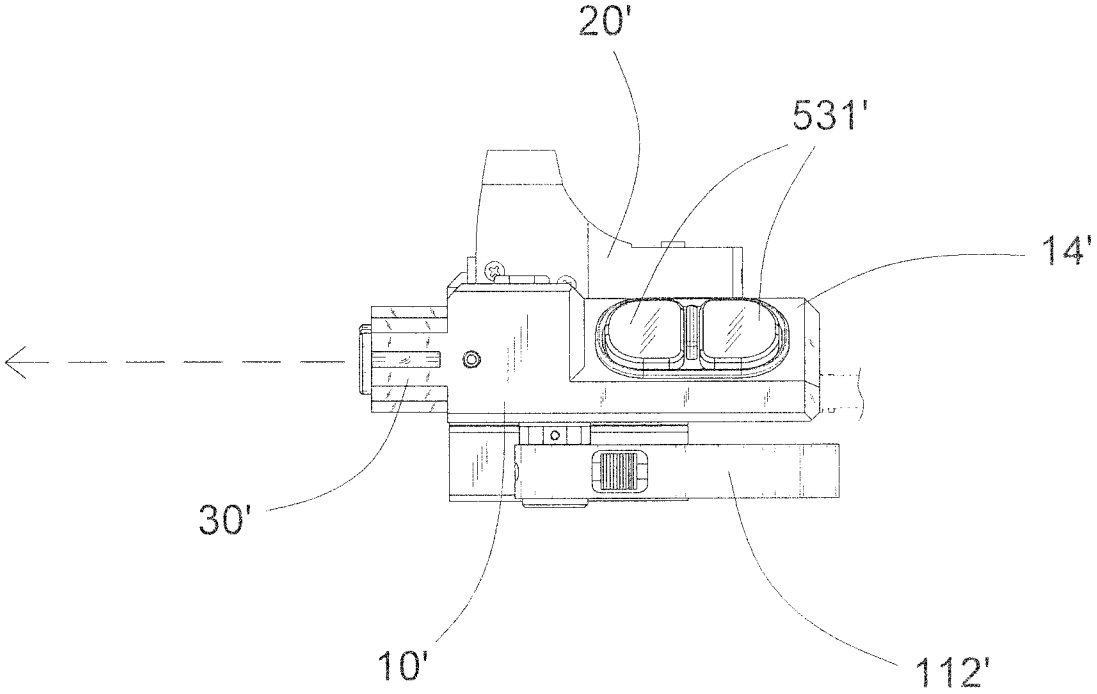
FIG. 9 is a side view of the sight device according to the above second preferred embodiment of the present invention.
Figure 10:
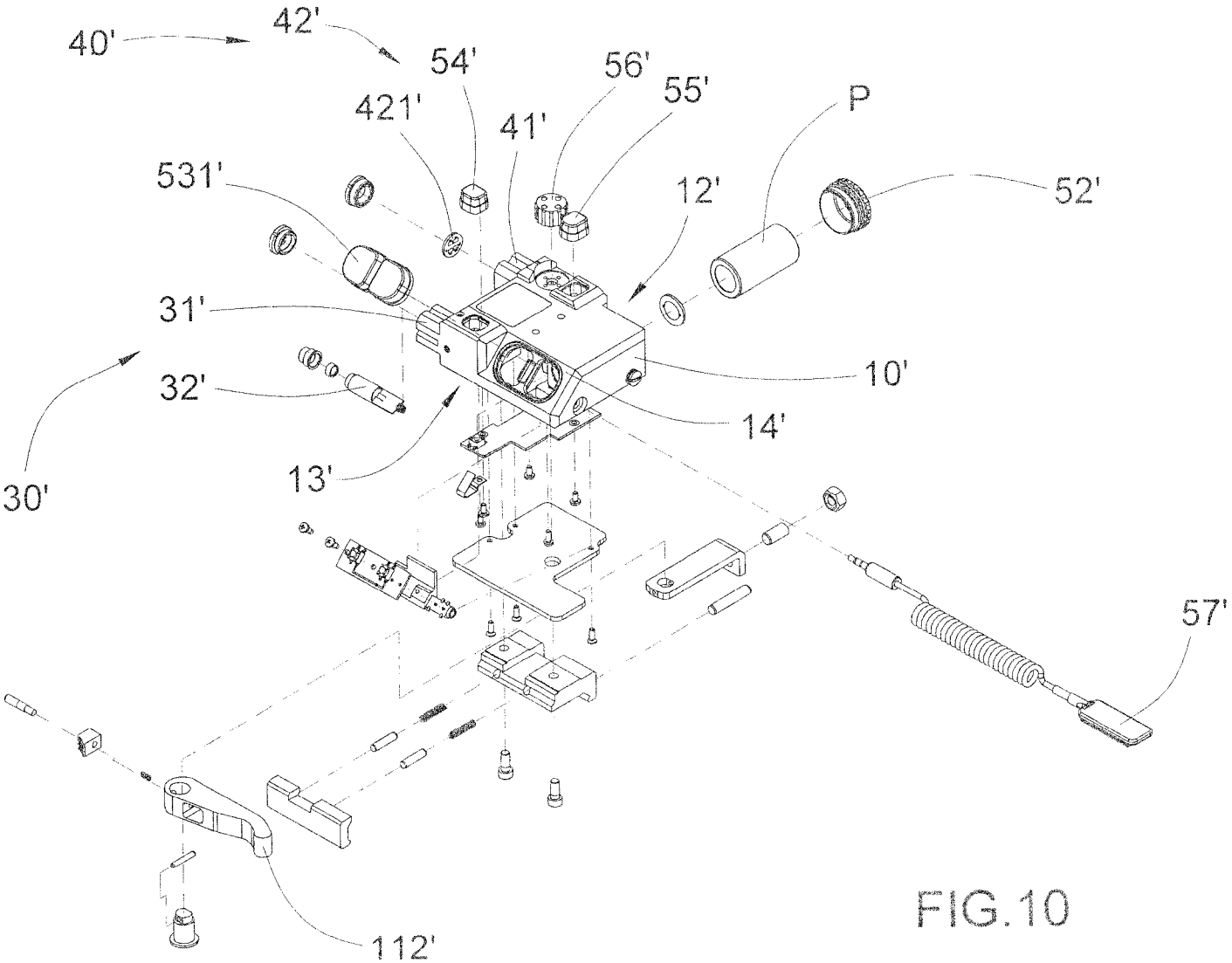
FIG. 10 is an exploded perspective view of the sight device according to the above second preferred embodiment of the present invention.

The sight arrangement further comprises an integrated control module 50' provided at the mounting base 10' to selectively operate the first and second sight modules 30', 40'. As shown in FIGS. 7 and 10, the integrated control module 50' comprises a power source compartment 51 formed at the sidewall of the mounting base 10', preferably at the finger side 12' of the mounting base 10', for receiving a power supply as a single power source to operatively link with the first light unit 32' and the second light unit 42', and a compartment cover 52' detachably coupled at the sidewall of the mounting base 10' to enclose the power source compartment 51'. Therefore, the first light unit 32' and the second light unit 42' will share one single power source P to reduce the overall weight of the sight device on the firearm and to simplify the electrical configuration of the sight device with respect to the sight modules 30', 40'.

The integrated control module 50' further comprises a control panel 53' provided at the sidewall of the mounting base 10', wherein a plurality of control switches 531' are provided at the control panel 53' for independently operating the sight modules 30', 40'. Accordingly, two control switches 531' serve as two momentary on and off switches provided at the thumb side 12' of the mounting base 10' to control the first and second sight modules 30', 40' respectively. When the first momentary on and off switch is pressed, the first light unit 32' is switched on in order to generate the laser beam. Once the depression of the first momentary on and off switch is released, the first light unit 32' is switched off instantly. Likewise, when the second momentary on and off switch is pressed, the second light unit 42' is switched on in order to generate the illumination light, i.e. the navigation light. Once the depression of the second momentary on and off switch is released, the second light unit 42' is switched off instantly. In other words, the operator is able to instantly switch on the first or second light unit 32', 42' by press-and-hold the first or second momentary on and off switch, and is able to instantly switch off the first or second light unit 32', 42' by releasing the depression of the first or second momentary on and off switch.

Accordingly, the mounting base 10' further has a slanted sidewall 14' formed at a rear portion, wherein the control switches 531' of the control panel 53' is provided at the slanted sidewall 14' of the mounting base 10'. Therefore, the control switches 531' on the control panel 53' allow the operator's hand on the firearm, such as the handguard of the rifle, easy access to activate the sight modules 30', 40'.

The integrated control module 50' further comprises first and second constant on and off switches 54', 55' provided on the top platform of the mounting base 10' and aligned with the first and second sight modules 30', 40' respectively. When the first constant on and off switch 54' is pressed, the first light unit 32' is switched on in order to generate the laser beam. When the first constant on and off switch 54' is pressed again, the first light unit 32' is switched off. Likewise, when the second constant on and off switch 55' is pressed, the second light unit 42' is switched on in order to generate the illumination light, i.e. the navigation light. When the second constant on and off switch 55' is pressed again, the second light unit 42' is switched off. In other words, the operator is able to constantly switch on the first or second light unit 32', 42' by first depression of the first or second constant on and off switch 54, 55', and is able to instantly switch off the first or second light unit 32', 42' by the second depression of the first or second constant on and off switch 54', 55'.

The integrated control module 50' further comprises a rotatable switch 56' provided on the top platform of the mounting base 10' and aligned with the second sight module 40', wherein the rotatable switch 56' is rotated to selectively activate one of the illumination elements 421' for generate the desired color of navigation light.

The integrated control module 50' further comprises a remote momentary pressure switch 57' detachably linked to the first and second sight modules 30', 40'. Accordingly, the remote momentary pressure switch 57' is linked to the sight arrangement via a wire, wherein the wire is plugged into a port at the rear wall of the mounting base 10', so as to operatively link the remote momentary pressure switch 57' with the first and second sight modules 30', 40'. In particular, the remote momentary pressure switch 57' is arranged to activate one of first and second light units 32', 42' at user's discretion.

Accordingly, the sight device according to the first and second embodiments has a compact and ergonomic design, wherein the low profile design of the mounting base 10, 10' can minimize the distance between the sight unit 20, 20' and the firearm. In addition, the sight arrangement is located close to the firearm for easy aiming and to reduce the off-axis bore height. When the sight device is mounted on the firearm, the sight device not only provides different sight aiming functions via the sight unit 20, 20' and the first sight module 30, 30' but also provide different navigation light functions via the second sight module 40, 40'. It is appreciated that one of the first and second sight modules 30, 30', 40, 40' can be a flashlight module or even a camera module.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A sight device configured for mounting on a firearm, comprising:

a mounting base configured for detachably mounting on said firearm;

a sight unit upwardly extended from said mounting base, wherein said sight unit is a reflex optic, comprising a lens housing upwardly extended from a top platform of said mounting base, an enlarged optic window supported in said lens housing for enhancing a wide field of view, a sight luminous element for generating a reflex optic dot on said optic window, and an armored shield mounted around said lens housing for protecting said lens housing from damage; and a sight arrangement, which is provided at said mounting base at a position underneath said sight unit, comprising:

a first sight module which comprises a first light housing frontwardly extended from said mounting base and a first light unit supported in said first light housing for generating a light beam parallel to a bore axis of said firearm and close to said bore axis of said firearm to reduce an off-axis bore height; and a second sight module which comprises a second light housing frontwardly extended from said mounting base and spaced apart from said first light housing, a second light unit supported in said second light housing for illumination wherein said first and second light housings are frontwardly extended from a front wall of said mounting base at two side portions thereof respectively, such that said sight unit is located between said first and second light housings.

2. The sight device, as recited in claim 1, wherein said second light unit comprises a plurality of illumination elements being selectively activated for generating navigation light in different colors respectively.

3. The sight device, as recited in claim 2, wherein said first light unit is a diode pumped solid state laser supported in said first light housing for generate a visible-light laser beam.

4. The sight device, as recited in claim 3, wherein said sight arrangement further comprises an integrated control module provided at said mounting base to operatively link with said sight luminous element, said first light unit, and said second light unit, so as to independently control reflex optic dot illumination level, activate said first light unit, and activate said second light unit respectively.

5. The sight device, as recited in claim 3, wherein said reflex optic comprises a micro reflex optic.

6. The sight device, as recited in claim 5, wherein said sight arrangement further comprises an integrated control module provided at said mounting base to operatively link with said first light unit and said second light unit, so as to independently activate said first light unit and activate said second light unit respectively.

7. The sight device, as recited in claim 6, wherein said mounting base has a slanted sidewall formed at a rear portion, wherein said integrated control module is formed at said slanted sidewall of said mounting base.

8. The sight device, as recited in claim 2, wherein said sight arrangement further comprises an integrated control module provided at said mounting base to operatively link with said sight luminous element, said first light unit, and said second light unit, so as to independently control reflex optic dot illumination level, activate said first light unit, and activate said second light unit respectively.

9. The sight device, as recited in claim 2, wherein said reflex optic comprises a micro reflex optic.

10. The sight device, as recited in claim 9, wherein said sight arrangement further comprises an integrated control module provided at said mounting base to operatively link with said first light unit and said second light unit, so as to independently activate said first light unit and activate said second light unit respectively.

11. The sight device, as recited in claim 10, wherein said mounting base has a slanted sidewall formed at a rear portion, wherein said integrated control module is formed at said slanted sidewall of said mounting base.

12. The sight device, as recited in claim 1, wherein said second light unit comprises a plurality of illumination elements being selectively activated for generating navigation light in different colors respectively.

13. The sight device, as recited in claim 12, wherein said first light unit is a diode pumped solid state laser supported in said first light housing for generate a visible-light laser beam.

14. The sight device, as recited in claim 1, wherein said first light unit is a diode pumped solid state laser supported in said first light housing for generate a visible-light laser beam.

15. The sight device, as recited in claim 1, wherein said sight arrangement further comprises an integrated control module provided at said mounting base to operatively link with said sight luminous element, said first light unit, and said second light unit, so as to independently control reflex optic dot illumination level, activate said first light unit, and activate said second light unit respectively.

16. The sight device, as recited in claim 1, wherein said reflex optic comprises a micro reflex optic.

17. The sight device, as recited in claim 14, wherein said sight arrangement further comprises an integrated control module provided at said mounting base to operatively link with said first light unit and said second light unit, so as to independently activate said first light unit and activate said second light unit respectively.

18. The sight device, as recited in claim 17, wherein said mounting base has a slanted sidewall formed at a rear portion, wherein said integrated control module is formed at said slanted sidewall of said mounting base.

* * * * *